US007476001B2

(12) United States Patent
Lanczy

(10) Patent No.: US 7,476,001 B2
(45) Date of Patent: Jan. 13, 2009

(54) LIGHT FIXTURE MOUNTING BRACKET AND METHOD

(75) Inventor: Geza T. Lanczy, Auburn, IN (US)

(73) Assignee: Group Dekko, Inc., Kendallville, IN (US)

( * ) Notice: Subject to any disclaimer, the term of this patent is extended or adjusted under 35 U.S.C. 154(b) by 194 days.

(21) Appl. No.: 11/444,071

(22) Filed: May 31, 2006

(65) Prior Publication Data

US 2006/0274535 A1 Dec. 7, 2006

Related U.S. Application Data

(60) Provisional application No. 60/687,692, filed on Jun. 6, 2005.

(51) Int. Cl.
*F21V 21/14* (2006.01)

(52) U.S. Cl. ..... 362/150; 362/404; 362/418

(58) Field of Classification Search ..... None
See application file for complete search history.

(56) References Cited

U.S. PATENT DOCUMENTS

| | | | | |
|---|---|---|---|---|
| 2,577,174 | A | 12/1951 | Worth | 240/78 |
| 2,967,040 | A | 1/1961 | Picha | 248/324 |
| 4,338,653 | A | 7/1982 | Marrero | 362/223 |
| 5,624,202 | A | 4/1997 | Grierson | 403/327 |
| 6,595,664 | B2 | 7/2003 | Bucher et al. | 362/404 |
| 6,619,919 | B2 | 9/2003 | Kerr, Jr. | 416/5 |
| 6,653,558 | B1 | 11/2003 | Bucher et al. | 174/50 |
| D490,559 | S | 5/2004 | Small | D26/138 |
| 6,979,108 | B1 * | 12/2005 | Berge | 362/442 |
| 6,981,679 | B1 * | 1/2006 | Mullen | 248/344 |
| 7,036,949 | B2 * | 5/2006 | Srass et al. | 362/96 |
| 2006/0016948 | A1 | 1/2006 | Herth | 248/318 |
| 2006/0018116 | A1 | 1/2006 | Plunk et al. | 362/217 |
| 2006/0193142 | A1 * | 8/2006 | Dupre | 362/418 |

* cited by examiner

*Primary Examiner*—Laura Tso
(74) *Attorney, Agent, or Firm*—Taylor & Aust, P.C.

(57) ABSTRACT

A light fixture mounting bracket for mounting a linear light fixture housing relative to a hung ceiling in one of a flush mount configuration and a suspended configuration. The light fixture mounting bracket includes at least one mounting surface configured for connection to the housing, and an enclosure connected to the at least one mounting surface. The enclosure is integral with the mounting surfaces, and both the mounting surfaces and the enclosure are formed from a single piece of material.

16 Claims, 4 Drawing Sheets

LIGHT FIXTURE MOUNTING BRACKET AND METHOD

CROSS REFERENCE TO RELATED APPLICATIONS

This is a non-provisional application based upon U.S. provisional patent application Ser. No. 60/687,692, entitled "LIGHT FIXTURE MOUNTING BRACKET AND METHOD", filed Jun. 6, 2005.

BACKGROUND OF THE INVENTION

1. Field of the Invention

The present invention relates to a light fixture mounting bracket, and, more particularly, to a light fixture mounting bracket for linear lighting.

2. Description of the Related Art

Light fixtures are known, and more particularly linear lighting fixtures, which in addition to providing suitable light for work areas, home, etc., also provide a decorative and/or aesthetic appeal to the indoor or outdoor environment. A variety of light fixture brackets are known which can attach a fixture to a junction box which box is typically mounted to a ceiling joist, for example. However, in the case of linear lighting, such a mounting bracket is not suitable, as the linear light fixture is typically flush mounted to a hung ceiling or mounted below a hung ceiling. Such a hung ceiling typically has a metal grid structure suspended from and below ceiling joists, and therefore is not in close enough proximity to the junction boxes to allow connection of the light fixture directly to the junction box. Further, even if a junction box was in close enough proximity to allow connection of the light fixture directly to the junction box, typical brackets, if used to mount the light fixture to the junction box, are detrimental to the decorative and/or aesthetic appeal of the fixture.

Canopy cans are known which provide a transition from the ceiling to the fixture which can typically be in the form of a metal cylinder. However, such canopy cans require a separate and additional bracket for assembly to the lighting fixture and/or ceiling. Although these canopy cans can help preserve the aesthetic appeal of the lighting fixture and mounting method, typical canopy cans are manufactured using a metal drawing process, and are thereby relatively expensive to manufacture.

What is needed in the art is a light fixture mounting bracket which is compatible with either a light fixture ceiling flush mount or light fixture mounted below the ceiling, which preserves the decorative and/or aesthetic appeal of the light fixture, and which is relatively cost effective to manufacture.

SUMMARY OF THE INVENTION

The present invention provides a single piece light fixture mounting bracket which preserves the decorative appeal of the fixture and which is relatively cost effective to manufacture.

The invention comprises, in one form thereof, a light fixture mounting bracket for mounting a linear light fixture housing relative to a hung ceiling in one of a flush mount configuration and a suspended configuration. The light fixture mounting bracket includes at least one mounting surface configured for connection to the housing, and an enclosure connected to the at least one mounting surface. The enclosure is integral with the mounting surfaces, and both the mounting surfaces and the enclosure are formed from a single piece of material.

The invention comprises, in another form thereof, a linear light fixture which includes a source of light, a housing connected to the source of light and a mounting bracket connected to the housing. The light fixture mounting bracket includes at least one mounting surface configured for connection to the housing, and an enclosure connected to the at least one mounting surface. The enclosure is integral with the mounting surfaces, and both the mounting surfaces and the enclosure are formed from a single piece of material.

The invention comprises, in yet another form thereof, a method of mounting a linear light fixture, including the steps of: providing a light fixture mounting bracket including at least one mounting surface configured for connection to a housing of the linear light fixture, and an enclosure connected to the mounting surface(s), the enclosure being integral with the mounting surfaces, both the mounting surfaces and the enclosure being formed from a single piece of material; connecting the linear light fixture to the at least one mounting surface; and mounting the linear light fixture in one of a flush mount configuration and a suspended configuration.

An advantage of the present invention is that it is compatible with either a light fixture ceiling flush mount or light fixture mounted below the ceiling.

Another advantage of the present invention is that it preserves the decorative and/or aesthetic appeal of the light fixture.

Yet another advantage of the present invention is that it is relatively cost effective to manufacture.

Yet another advantage of the present invention is that it eliminates the separate bracket of known canopy cans.

Yet another advantage of the present invention is that it is less obtrusive than known canopy cans.

Yet another advantage of the present invention is that it can be manufactured from a single piece of material.

Yet another advantage of the present invention is that it can be manufactured using a stamping operation.

Yet another advantage of the present invention is that it can be formed using a stamping operation with a progressive die.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
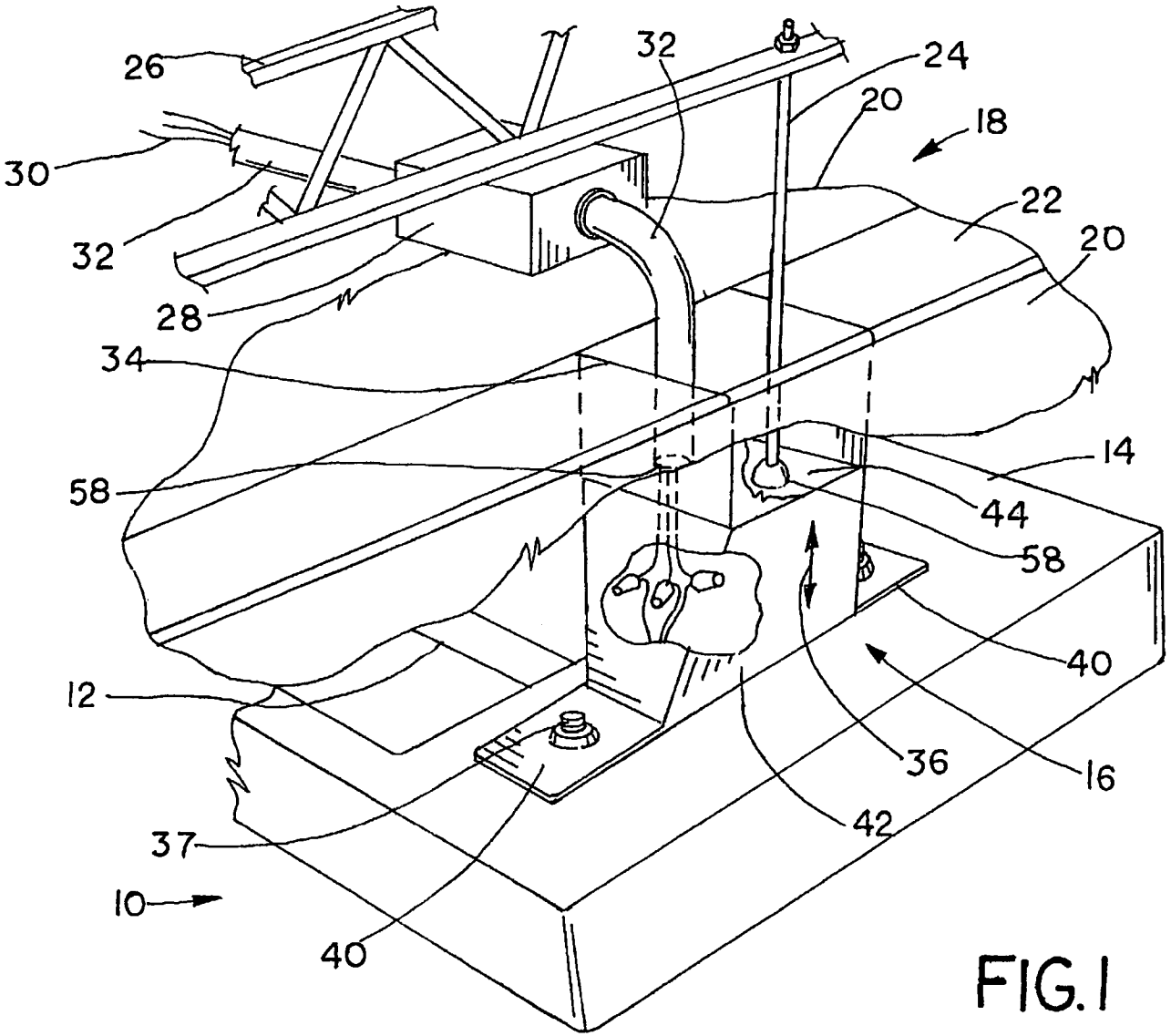
FIG. 1 is a perspective, fragmentary view of an embodiment of a linear light fixture including a light fixture mounting bracket according to the present invention, and as viewed from a ceiling.

Referring now to the drawings, and more particularly to FIG. 1, there is shown a linear light fixture 10 which generally includes a source of light 12, a housing 14 connected to source of light 12, and a light fixture mounting bracket 16 connected to housing 14. Linear light fixture 10 can be positioned next to a suspended or hung ceiling 18 which can include ceiling tiles 20 and ceiling grid 22 which supports the ceiling tiles. A hanger 24 can be connected to a ceiling joist 26 to support fixture 10 via connection to bracket 16 and/or housing 14. An electrical junction box 28 can provide electrical power to fixture 10 via electrical wires 30 in conduit 32. Light fixture 10 can be in a flush mount configuration, or a suspended configuration relative to ceiling 18 by adjustment of hanger 24 so as to pull bracket 16 into clearance 34 of ceiling 18 and thereby make the top side of housing 14 relatively flush with the bottom side of ceiling 18, or adjust hanger 24 to lower the top side of housing 14 relative to the bottom side of ceiling 18, respectively, as shown by arrow 36. Bracket 16 can be connected to housing 14 with suitable fasteners 37.

Figure 2:
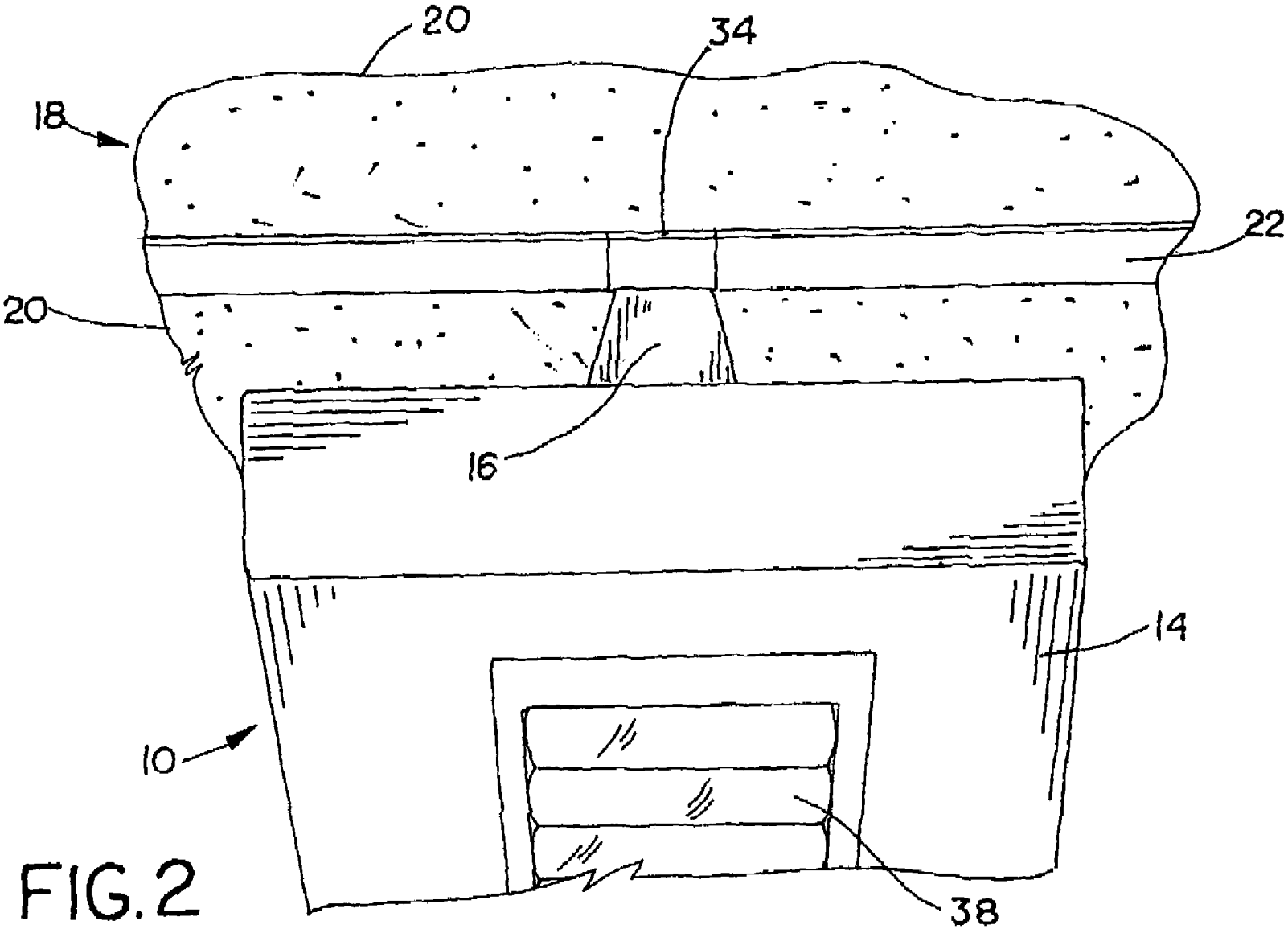
FIG. 2 is a perspective, fragmentary view of the linear light fixture of FIG. 1, as viewed from underneath the light fixture.

Linear light fixture can include wiring, electrical/electronic controls, ballasts, reflectors (all not shown), and other components as are known, and can also include lens 38 as shown in FIG. 2. Source of light 12 can be fluorescent bulbs, incandescent bulbs, metal halide bulbs, light emitting diode (s), lasers, other light sources and/or an array or combination thereof.

Figure 3:
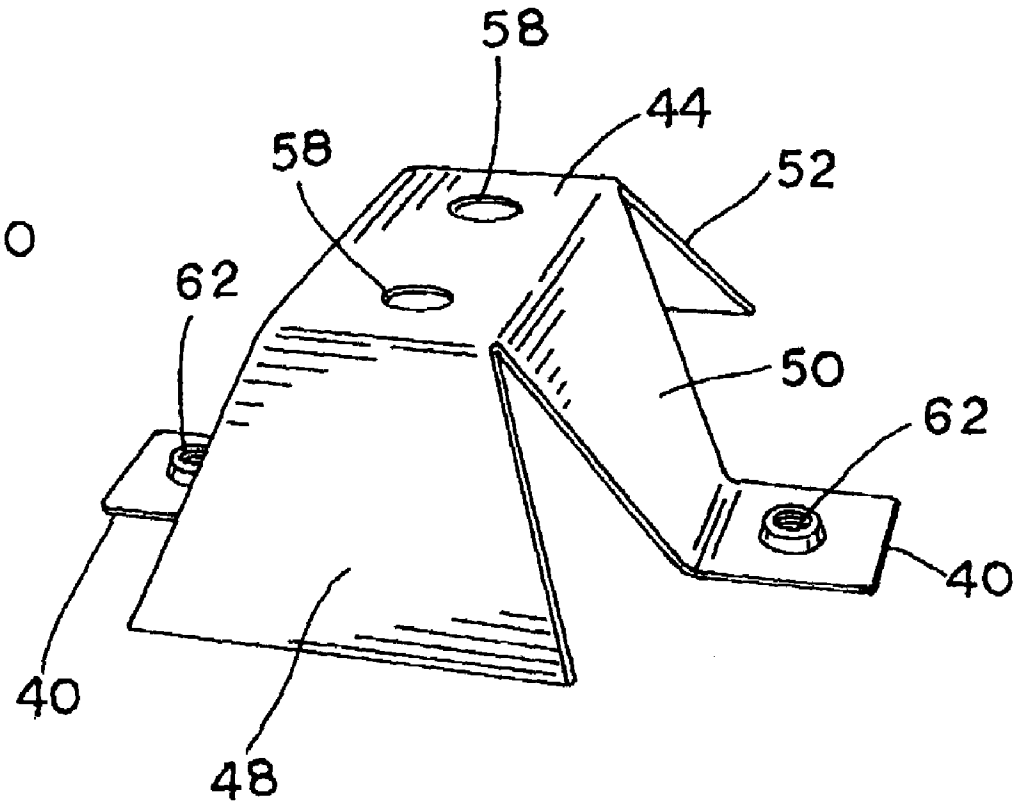
FIG. 3 is a perspective view of a partially formed light fixture mounting bracket.
Figure 4:
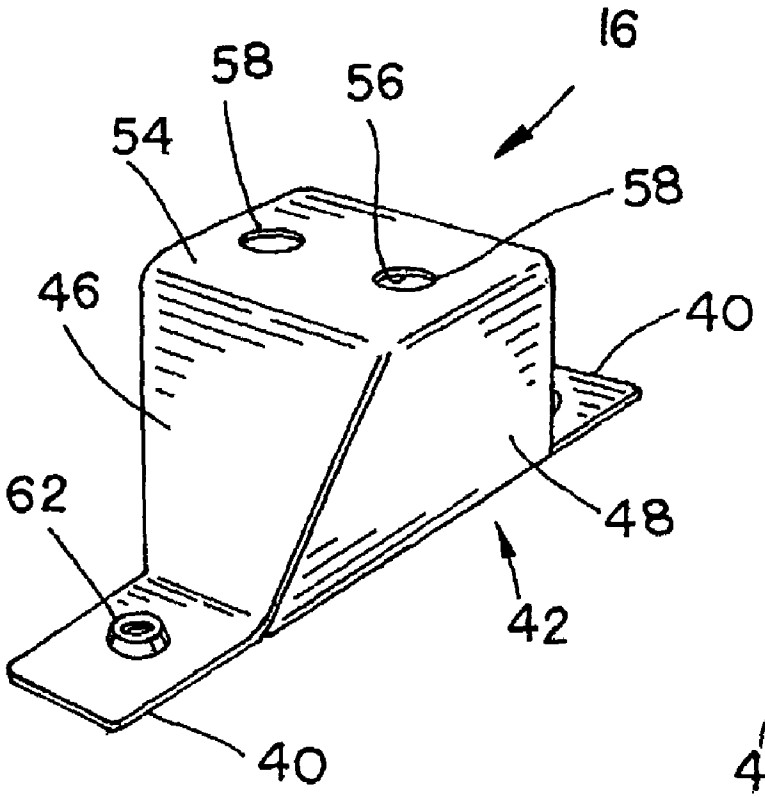
FIG. 4 is a perspective view of the light fixture mounting bracket of FIG. 1.

Referring particularly to FIGS. 3 and 4, mounting bracket 16 includes at least one mounting surface 40 configured for connection to housing 14 and an enclosure 42 connected to mounting surfaces 40. Enclosure 42 is integral with mounting surfaces 40, and both mounting surfaces 40 and enclosure 42 can be formed from a single piece of material, for example, a metal such as steel or aluminum, composite materials, plastic materials, or other materials.

Enclosure 42 includes an aperture plate 44, and a first side 46, a second side 48, a third side 50 and a fourth side 52 all directly connected to aperture plate 44. Aperture plate 44 includes a first surface 54 and a second surface 56 opposite first surface 54, and at least one aperture 58 extending from first surface 54 through second surface 56. Each of mounting surfaces 40 can extend from at least one of sides 46, 48, 50, 52.

Mounting surfaces 40 can be a relatively flat plate like structure as is shown, or other shapes to accommodate corresponding mounting surfaces on housing 14. Mounting surfaces 40 can extend obtusely from at least one of sides 46, 48, 50, 52, or at other angles varying from 0° to 360°. Each of mounting surfaces 40 can include a threaded hole 62 extending through the plate. Threaded hole 62 can also be a threaded insert, for example.

At least one of sides 46, 48, 50, 52 can include a trapezoidal profile as is shown, or other profiles such as rectangular or other shapes.

Figure 5:
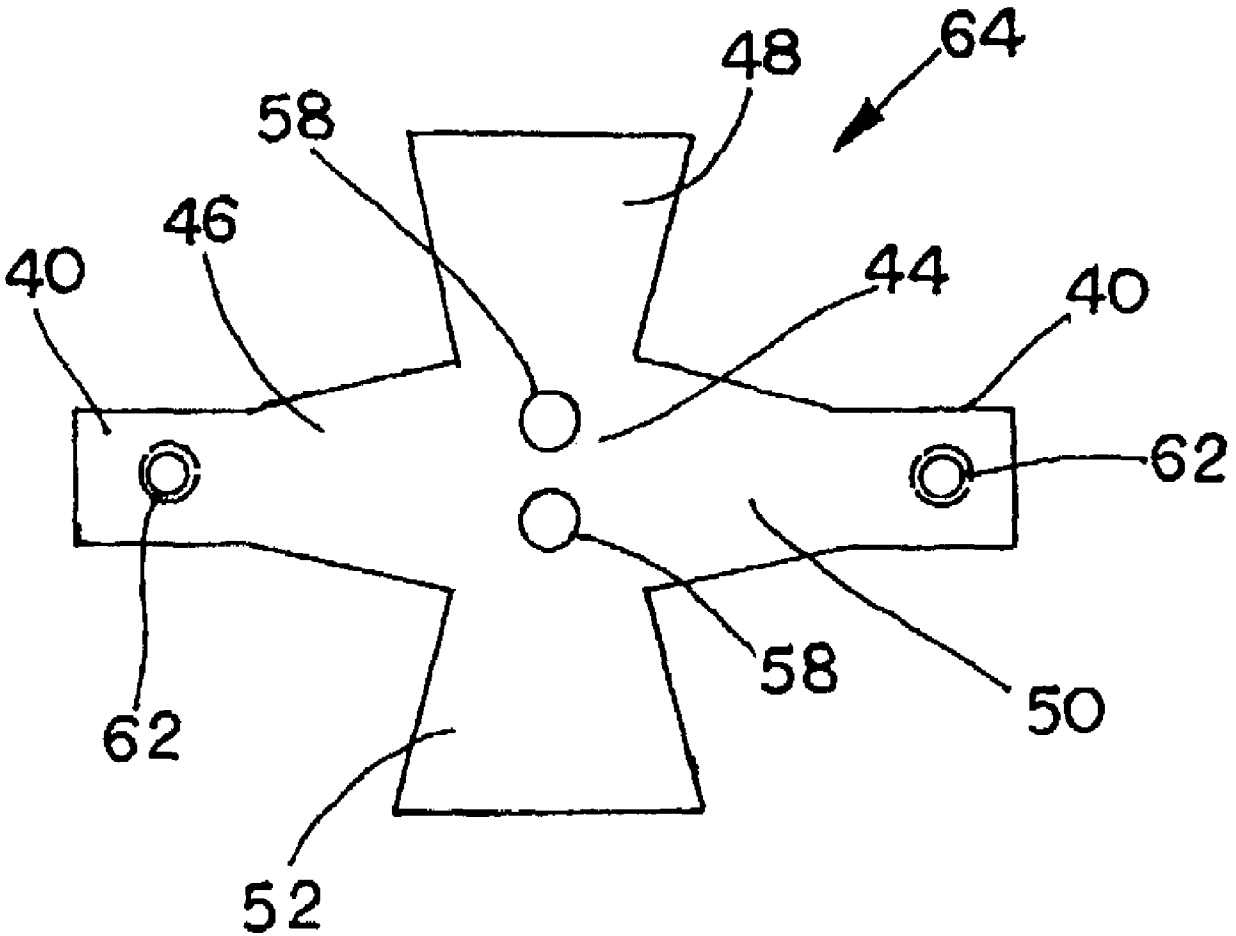
FIG. 5 is a top view of an embodiment of a single piece of material used in forming the light fixture mounting bracket of FIG. 4.

In use, the present invention discloses a method of mounting a linear light fixture, including the steps of: providing light fixture mounting bracket 16 including at least one mounting surface 40 configured for connection to housing 14; and an enclosure 42 connected to the mounting surfaces 40, enclosure 42 being integral with mounting surfaces 40, and both mounting surfaces 40 and enclosure 42 being formed from a single piece of material, as is shown particularly in FIGS. 3-5; connecting linear light fixture 10 to at least one mounting surface 40; and mounting linear light fixture 10 in one of a flush mount configuration and a suspended configuration. The method of the present invention can further include the step of forming light fixture mounting bracket 16 to include an aperture plate 44, and sides 46, 48, 50, 52 all directly connected to aperture plate 44, and at least one mounting surface 40 extending from at least one of sides 46, 48, 50, 52. Bracket 16 can be formed from a single piece of material 64 (FIG. 5) by stamping the form shown in FIG. 5 from sheet metal, and then bending bracket 16 into its final form, shown particularly in FIG. 4, using progressive dies or other bending and forming operations.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A light fixture mounting bracket for mounting a linear light fixture housing relative to a hung ceiling in one of a flush mount configuration and a suspended configuration, said light fixture mounting bracket comprising:

at least one mounting surface configured for connection to the housing; and an enclosure connected to said at least one mounting surface, said enclosure being integral with said at least one mounting surface, both said at least one mounting surface and said enclosure being formed from a single piece of sheet-like material.

2. The light fixture mounting bracket of claim 1, wherein said enclosure includes an aperture sheet, and a first side, a second side, a third side and a fourth side all directly connected to said aperture sheet.

3. The light fixture mounting bracket of claim 2, wherein said aperture sheet includes a first surface and a second surface opposite said first surface, and at least one aperture extending from said first surface through said second surface.

4. The light fixture mounting bracket of claim 2, wherein each of said at least one mounting surface extend from at least one of said first side, said second side, said third side and said fourth side.

5. The light fixture mounting bracket of claim 4, wherein at least one mounting surface extends obtusely from at least one of said first side, said second side, said third side and said fourth side.

6. The light fixture mounting bracket of claim 4, wherein each said mounting surface includes a threaded hole extending through said flat sheet.

7. The light fixture mounting bracket of claim 2, wherein at least one of said first side, said second side, said third side and said fourth side includes a trapezoidal profile.

8. A linear light fixture, comprising:

a source of light;

a housing connected to said source of light;

a mounting bracket connected to said housing, said mounting bracket including:

at least one mounting surface configured for connection to the housing; and an enclosure connected to said at least one mounting surface, said enclosure being integral with said at least one mounting surface, both said at least one mounting surface and said enclosure being formed from a single piece of sheet-like material.

9. The linear light fixture of claim 8, wherein said enclosure includes an aperture sheet, and a first side, a second side, a third side and a fourth side all directly connected to said aperture sheet.

10. The linear light fixture of claim 9, wherein said aperture sheet includes a first surface and a second surface opposite said first surface, and at least one aperture extending from said first surface through said second surface.

11. The linear light fixture of claim 9, wherein each of said at least one mounting surface extend from at least one of said first side, said second side, said third side and said fourth side.

12. The linear light fixture of claim 11, wherein at least one mounting surface extends obtusely from at least one of said first side, said second side, said third side and said fourth side.

13. The linear light fixture of claim 11, wherein each said mounting surface includes a threaded hole extending through said flat sheet.

14. The linear light fixture of claim 9, wherein at least one of said first side, said second side, said third side and said fourth side includes a trapezoidal profile.

15. A method of mounting a linear light fixture, comprising the steps of:

providing a light fixture mounting bracket including at least one mounting surface configured for connection to a housing of said linear light fixture, and an enclosure connected to said at least one mounting surface, said enclosure being integral with said at least one mounting surface, both said at least one mounting surface and said enclosure being formed from a single piece of sheet-like material;

connecting said linear light fixture to said at least one mounting surface; and mounting said linear light fixture in one of a flush mount configuration and a suspended configuration.

16. The method of claim 15, further including the step of forming said light fixture mounting bracket to include an aperture sheet, and a first side, a second side, a third side and a fourth side all directly connected to said aperture sheet, and at least one mounting surface extending from at least one of said first side, said second side, said third side and said fourth side.

* * * * *